US006931777B1

(12) United States Patent
Krien

(10) Patent No.: US 6,931,777 B1
(45) Date of Patent: Aug. 23, 2005

(54) GUN REST

(76) Inventor: Gary L. Krien, 4672 W. Stimmel Rd., Salina, KS (US) 67401

( * ) Notice: Subject to any disclaimer, the term of this patent is extended or adjusted under 35 U.S.C. 154(b) by 0 days.

(21) Appl. No.: 10/421,342

(22) Filed: Apr. 23, 2003

Related U.S. Application Data

(60) Provisional application No. 60/384,516, filed on May 29, 2002.

(51) Int. Cl.[7] ..... F41A 29/00

(52) U.S. Cl. ..... 42/94; 89/37.01; 89/37.04

(58) Field of Search ..... 42/94; 89/37.01, 89/37.04; 22/108

(56) References Cited

U.S. PATENT DOCUMENTS

| | | | | | |
|---|---|---|---|---|---|
| 499,315 | A | * | 6/1893 | Borchardt | 42/94 |
| D203,680 | S | * | 2/1966 | Allison | D22/108 |
| 3,827,172 | A | * | 8/1974 | Howe | 42/94 |
| 4,026,057 | A | * | 5/1977 | Cady | 42/94 |
| 4,972,619 | A | * | 11/1990 | Eckert | 42/94 |
| 5,081,783 | A | * | 1/1992 | Jarvis | 42/94 |
| 5,628,135 | A | * | 5/1997 | Cady | 42/94 |
| 5,913,667 | A | * | 6/1999 | Smilee | 42/94 |
| D471,248 | S | * | 3/2003 | Jacobs | D22/108 |
| 6,526,687 | B1 | * | 3/2003 | Looney | 42/94 |
| 6,546,662 | B1 | * | 4/2003 | Chong | 42/94 |

FOREIGN PATENT DOCUMENTS

| | | | | |
|---|---|---|---|---|
| DE | 3204082 A1 | * | 8/1983 | 42/94 |
| DE | 4000091 A1 | * | 7/1991 | 42/94 |

* cited by examiner

*Primary Examiner*—Michael J. Carone
*Assistant Examiner*—L. Semunegus
(74) *Attorney, Agent, or Firm*—Westman, Champlin & Kelly, P.A.

(57) ABSTRACT

A gun rest has a first support mounted to a base and a support arm pivotally mounted to the first support. A platform for supporting a firearm barrel is mounted to the support arm. A manually-operable adjustment assembly couples the first support to the support arm to fixedly adjust an angular position of the platform relative to the base. The adjustment assembly has first and second fasteners pivotally mounted to the first support and to the support arm, and a manually-operable coupler threaded to the fasteners to selectively alter a distance between the first and second fasteners. A second platform mounted to the base supports a firearm stock, and an optional third platform is removably attachable to the support arm to support a pistol grip and hand of a user.

16 Claims, 1 Drawing Sheet

FIG. 1
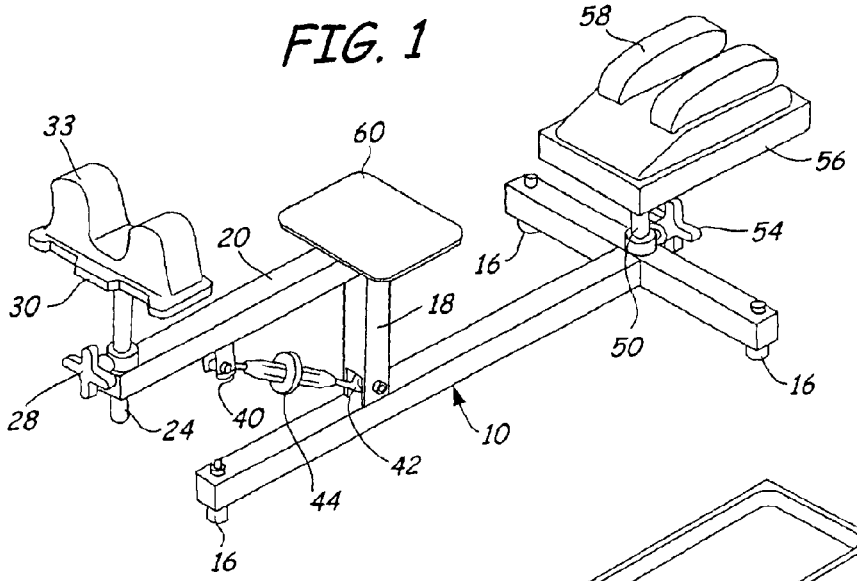
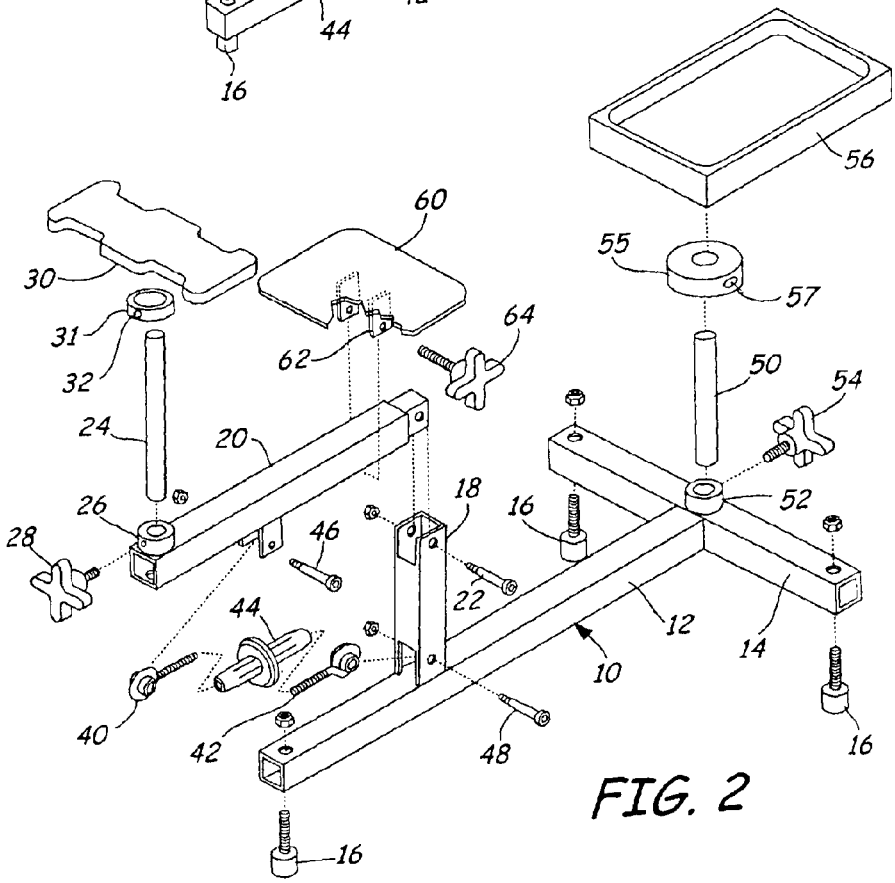
FIG. 2

GUN REST

CROSS-REFERENCE TO RELATED APPLICATIONS

This application claims benefit of U.S. Provisional Application No. 60/384,516 filed May 29, 2002 for "Gun Rest" by Gary L. Krien.

FIELD OF THE INVENTION

This invention relates to adjustable gun rests, and particularly to gun rests supporting an elevation of a forward part of the firearm, such as the barrel, for adjusting the orientation of the muzzle of the firearm.

BACKGROUND OF THE INVENTION

Gun rests are used to support firearms in a fixed position during target practice and competitions, as well as to adjust sights, including telescopic sights, of the firearm. Typically, gun rests include resilient bags, such as a plastic bag filled with a moldable or pliable material like sand. The bag conforms to the shape of the barrel of the firearm to hold the barrel in a fixed position. A second bag, also filled with moldable material, is used with rifles to hold the stock of the firearm in a fixed position.

One important consideration to a gun rest is the ability to adjust the elevation of the muzzle relative to the breech of the firearm. Previous gun rests required removal of the firearm from the rest before the gun rest could be adjusted. Where the prior gun rest was a fixed platform with moldable bags to support the barrel (and stock in the case of a rifle), an adjustment of the elevation of the muzzle of the firearm required removing the firearm from the conforming bags, and adjusting the bag shape to conform to an altered elevation of the firearm muzzle. Other gun rests provided adjustment of the fixed platform so that the elevation of the muzzle could be changed without re-conforming the conformable bags to the firearm, but these gun rests required removal of the weapon from the gun rest before adjusting the gun rest could be adjusted. More particularly, the gun rest could not be adjusted by the user while holding the firearm. There has been no practical gun rest permitting adjustment of the muzzle elevation by the user while the user holds the weapon in position on the gun rest.

The present invention is directed to a gun rest that solves this problem and permits single-handed adjustment of the elevation of the muzzle of the firearm while the firearm is held in position in the gun rest.

SUMMARY OF THE INVENTION

A gun rest according to a first embodiment of the invention includes a base having a first support. A platform for supporting a firearm barrel is mounted to a support arm, which is pivotally mounted to the first support. An adjustment assembly couples the first support to the support arm to rigidly orient the support arm at a selected angular position.

In preferred embodiments the adjustment assembly includes first and second threaded fasteners pivotally mounted to the first support and to the support arm, respectively. A coupler is fastened to the threaded fasteners to selectively alter a distance between the first and second fasteners.

Also preferably, a platform for supporting a firearm stock is mounted to a second support, which in turn is mounted to the base.

Optionally, another platform is removably attached to the support arm for supporting a pistol grip and user's hand.

BRIEF DESCRIPTION OF THE DRAWINGS

FIG. 1 is a perspective view of a gun rest according to an embodiment of the present invention.

FIG. 2 is an exploded assembly view of the gun rest shown in FIG. 1 with gun support bags removed for sake of clarity.

DETAILED DESCRIPTION OF THE PREFERRED EMBODIMENTS

FIGS. 1 and 2 illustrate a gun rest in accordance with an embodiment of the present invention. The gun rest has a T-shaped steel base member 10 having long member 12 and a rear cross-member 14. Feet 16 are threadably fastened to the forward end of member 12 and to each end of cross-member 14, and are arranged to engage a rigid support plane, such as the ground or a table top.

A vertical support member 18 is attached to member 12, such as by welding, and support arm 20 is pivotally mounted by pivot pin 22 to an upper end of support member 18. Tubular support member 24 is slidably received in receiver 26 of arm 20 so that member 24 is substantially normal or perpendicular to arm 20. Member 24 is locked to a selected elevation by fastener 28, threadably engaged to receiver 26 to bear against support 24. Conveniently, fastener 28 includes a knob to permit turning the fastener by hand. Thus, the position of member 24 relative to member to is fixed by frictional engagement of fastener 28 to member 24 and may be adjusted by the user without need of special tools.

Platform 30 includes a lock collar 31 fastened to it's underside (shown separated in FIG. 2), such as by welding. A set screw 32 locks support 24 to the collar and platform by friction engagement. A resilient bag 33 (FIG. 1) is supported by platform 30 for supporting the barrel of a firearm to be supported by the gun rest. Bag 32 may, for example, be a plastic bag filled with sand or other deformable material to allow the bag to be shaped to conform to the barrel.

An adjustment mechanism, composed of threaded fasteners 40 and 42 coupler 44, is pivotally mounted to support arm 20 and support 18 by pins 46 and 48, respectively. More particularly, pins 46 and 48 are mounted to arm 20 and support 18 to provide pivots about which fasteners 40 and 42 may rotate. Coupler 44 is threadably coupled to fasteners 40 and 42 so that upon rotation of coupler 44, fasteners 40 and 42 draw toward or away from each other along an axis between the pivot points formed by pins 46 and 48, thereby altering the distance between fasteners 40 and 42 along an axis between the pivot points. Changing the distance between the pivot points causes arm 20 to rotate about its pivot pin 22, thereby altering the angle of arm 20 relative to support 18. Consequently, the elevation of the barrel of the firearm is changed relative to support 10. Conveniently, coupler 44 includes a serrated surface allowing the user to easily grip and rotate the coupler by hand, without the use of special tools.

Support member 50 is received in receiver 52 on base 10 distally rearward from support member 18. Member 50 is locked in place substantially normal or perpendicular to base 10 by frictional engagement of threaded fastener 54 to member 50. Conveniently, fastener 54 also has a knob for easy manual operation. Collar 55 is rigidly attached to an underside of platform 56, such as by welding, and receives the upper end of member 50. Set screw 57 locks member 50 to collar 55. A resilient bag 58 (FIG. 1), similar to bag 33, is supported by platform 56. Bag 58 may be shaped to conform to the stock of a rifle.

In use, the user positions a rifle so that bag 33 conforms to and supports the barrel, and bag 58 conforms to and supports the stock of the rifle. With fasteners 28 and 54 loosened, the user independently adjusts the vertical positions of platforms 28 and 56, thereby orienting the firearm. Platforms 28 and 56 are locked into position by tightening fasteners 28 and 54, and the user positions the rifle to a shooting position relative to the user. The user, while positioning the firearm with one hand, rotates coupler 44 relative to fasteners 40 and 42, to thereby finely adjust the elevation of platform 30 and the barrel of the firearm relative to base 10 and the ground or support plane. Since the stock of the firearm is supported by platform 56, adjustment of the elevation of the barrel of the firearm alters the elevation and angle of the muzzle of the firearm. The threaded coupling of coupler 44 to fasteners 40 and 42 provides a positive connection so when a desired muzzle elevation is reached, the user simply stops rotating the coupler and the adjustment mechanism retains platform 30 at the selected elevation.

To accommodate pistols, a removable platform 60 includes a bracket 62 arranged to slide over arm 20. Threaded fastener 64, which includes a knob for easy manual operation, is threaded through bracket 62 on the opposite side of arm 20 from platform 60. Fastener 64 compresses bracket 62 to arm 20 to hold platform 60 in place. Fastener 64 permits quick assembly and disassembly of platform 60 from arm 20, as well as the relative positioning of platform 60 along the length of arm 20.

In the use of the gun rest for a pistol, a user adjusts the position of platform 60 along arm 20 so that the user's hand and the grip of the pistol are supported on platform 60 and the barrel of the pistol are supported by and conforms to bag 33. The angle of arm 20 may be altered by manual rotation of coupler 44, as previously described, thereby altering the angular orientation of the barrel relative to the base.

Users may find it convenient to remove platform 60 when using the gun rest with a rifle, arid/or remove platform 56 when using the gun rest with a pistol. Thus, platform 60 can be selectively assembled to or removed from arm 20 by fastener 64, and platform 56 (at its support 50) may be selectively assembled to or removed from the base by fastener 54.

The base member 10, support 18 and arm 20 are preferably constructed of number 1 square tubular steel, supports 24 and 50 are preferably constructed of ½-inch diameter steel, and platforms 30, 56 and 60 are preferably constructed of 3/16-inch number 1 steel, although other suitable materials may be employed. For example, the supports and arms might be constructed of aluminum, and the platforms might be constructed of a suitable polycarbonate or other plastic material.

Although the present invention has been described with reference to preferred embodiments, workers skilled in the art will recognize that changes may be made in form and detail without departing from the spirit and scope of the invention.

What is claimed is:

1. A gun rest comprising:

a base;

a support arm having a first end pivotally mounted to the base;

a first platform mounted to the support arm for supporting a barrel of a firearm;

a manually-operable adjustment assembly coupled to the base and the support arm to selectively and fixedly adjust the angular position of the support arm relative to the base;

a support member mounted to the base distal from the pivot mount for the support arm;

a second platform mounted to the support member for supporting a stock of a rifle;

an adjustable coupler coupling the support member to the base to adjust the position of the second platform relative to the base; and wherein height of the first platform is adjustable by pivoting the support arm about the pivoted mount.

2. The gun rest of claim 1, wherein the base includes a first support, and the support arm is pivotally mounted to the first support, the gun rest further including:

a plurality of feet arranged to engage a support surface to orient the first support to a substantially vertical orientation.

3. The gun rest of claim 2, including:

a second support coupled to the support arm in an orientation substantially perpendicular to the support arm, and an adjustable second coupler coupling the second support to the support arm to adjust a position of the first platform relative to the support arm.

4. The gun rest of claim 1, further including:

a first cushion on the first platform, the first cushion being conformable to a shape of the firearm barrel.

5. The gun rest of claim 1, further including:

a second cushion on the second platform, the second cushion being conformable to a shape of the firearm stock.

6. The gun rest of claim 1, wherein the support member comprises a third support oriented substantially perpendicular to the base.

7. The gun rest of claim 2, further including:

a third platform for supporting a hand of a user holding a pistol while the barrel of the pistol is supported on the first platform, and a fastener removably attaching the second platform to the support arm.

8. The gun rest of claim 1, further including:

a third platform for supporting a hand of a user holding a pistol while the barrel of the pistol is supported on the first platform, and a fastener removably attaching the second platform to the base.

9. The gun support of claim 1, wherein the adjustment assembly comprises:

a first fastener pivotally mounted to the base, a second fastener pivotally mounted to the support arm, and a manually-operable coupler fastened to the first and second fasteners to selectively alter a distance between the first and second fasteners.

10. The gun rest of claim 9, wherein the first and second fasteners are rigid threaded fasteners, and the coupler includes a threaded portion engaging the first and second fasteners to orient the first and second fasteners along an axis, the threaded portion of the coupler being arranged relative to the first and second fasteners so that rotation of the coupler in a first direction about the axis draws the first and second fasteners toward each other and rotation of the coupler in a second direction about the axis opposite the first direction pushes the first and second fasteners from each other.

11. The gun rest of claim 9, including:

a second support coupled to the support arm in an orientation substantially normal to the support arm, and an adjustable second coupler coupling the second support to the support arm to adjust a position of the first platform relative to the support arm.

12. The gun rest of claim 9, wherein the support member comprises a third support oriented substantially normal to the base.

13. The gun rest of claim 9, further including:

a third platform for supporting a hand of a user holding a pistol while the barrel of the pistol is supported on the first platform, and a fastener removably attaching the second platform to the support arm.

14. The gun support of claim 2, wherein the adjustment assembly comprises:

a first fastener pivotally mounted to the first support between the base and the support arm, a second fastener pivotally mounted to the support arm, and a manually-operable coupler fastened to the first and second fasteners to selectively alter a distance between the first and second fasteners.

15. The gun rest of claim 14, wherein the base includes a plurality of feet arranged to engage a support surface to orient the first support to a substantially vertical orientation.

16. The gun rest of claim 15, wherein the first and second fasteners are rigid threaded fasteners, and the coupler includes a threaded portion engaging the first and second fasteners to orient the first and second fasteners along an axis, the threaded portion of the coupler being arranged relative to the first and second fasteners so that rotation of the coupler in a first direction about the axis draws the first and second fasteners toward each other and rotation of the coupler in a second direction about the axis opposite the first direction pushes the first and second fasteners from each other.

* * * * *

UNITED STATES PATENT AND TRADEMARK OFFICE

CERTIFICATE OF CORRECTION

PATENT NO. : 6,931,777 B1
DATED : August 23, 2005
INVENTOR(S) : Krien

It is certified that error appears in the above-identified patent and that said Letters Patent is hereby corrected as shown below:

Column 6,
Line 10, "claim 15" should be -- claim 14 --.

Signed and Sealed this

Twenty-fifth Day of October, 2005

JON W. DUDAS
*Director of the United States Patent and Trademark Office*